United States Patent [19]

Lindahl

[11] 4,263,879

[45] * Apr. 28, 1981

[54] WATER HEATER

[75] Inventor: John R. Lindahl, Chapmansboro, Tenn.

[73] Assignee: State Industries, Inc., Ashland City, Tenn.

[ * ] Notice: The portion of the term of this patent subsequent to Jun. 5, 1996, has been disclaimed.

[21] Appl. No.: 8,275

[22] Filed: Feb. 1, 1979

Related U.S. Application Data

[63] Continuation-in-part of Ser. No. 854,721, Nov. 25, 1977, Pat. No. 4,157,077.

[51] Int. Cl.[1] ..... F22B 9/04; F22D 7/04

[52] U.S. Cl. ..... 122/159; 122/406 R; 122/408 R

[58] Field of Search ..... 122/115, 159, 406 R, 122/407, 408 R, 409, 410

[56] References Cited

U.S. PATENT DOCUMENTS

| | | | |
|---|---|---|---|
| 385,872 | 7/1888 | Miller et al. | 137/590.5 |
| 1,536,613 | 5/1925 | Lyons | 122/159 |
| 2,593,946 | 4/1952 | Weldy | 122/408 R |
| 2,814,278 | 11/1957 | Cameron | 122/159 |
| 3,762,395 | 10/1973 | Taylor | 126/350 R |
| 4,037,569 | 7/1977 | Bennett et al. | 122/32 |
| 4,157,077 | 6/1979 | Lindahl | 122/406 R |

FOREIGN PATENT DOCUMENTS

| | | | |
|---|---|---|---|
| 111802 | 10/1940 | Australia | 122/159 |

*Primary Examiner*—Anthony V. Ciarlante

*Attorney, Agent, or Firm*—Michael, Best & Friedrich

[57] ABSTRACT

A water heater including a watertight tank having a source of heat for heating water inside the tank and a hot water outlet mounted in the top portion of the tank. An agitator assembly is mounted in the bottom portion of the tank and includes a ring-shaped tubular member and a secondary tubular member connected to the ring-shaped tube. The ring-shaped member is provided with a plurality of openings in the sides thereof and said secondary tubular member is provided with an upwardly facing opening therein. A plurality of horizontally extending venturi fittings are mounted in the ring-shaped member side openings and an upwardly extending venturi fitting is mounted in the secondary tubular member opening. The agitator assembly is connected to a source of water so that when hot water is periodically withdrawn from the top of the tank water will flow into the tank through the openings and venturi fittings in the agitator assembly. Such openings and fittings are positioned so that water flowing from inside the tubular members into the tank will flow in horizontal and centerally upward directions to thereby produce a substantially uniform stirring action in the bottom portion of the tank. Such stirring action will cause any solid particles in the water to be circulated upwardly and carried from the tank to thus prevent accumulation of such particles in the bottom of the tank.

8 Claims, 3 Drawing Figures

WATER HEATER

CROSS-REFERENCE TO RELATED APPLICATION

This application is a continuation-in-part of Application Ser. No. 854,721 filed Nov. 25, 1977 entitled "Water Heater" (now U.S. Pat. No. 4,157,077 dated June 5, 1979).

BACKGROUND OF THE INVENTION

I. Field of the Invention

This invention relates to water heaters and more particularly to a water heater equipped with a specially designed agitator means which is effective to prevent accumulation of scale and other solid particles in the bottom portion thereof.

II. Description of the Prior Art

A longstanding problem in the water heater industry is the tendency of dissolved solid particles to precipitate out of the water being heated which particles will accumulate in the bottom of the tank causing adverse operation and tank longevity. To applicant's knowledge prior to the present invention there was nothing available to alleviate this serious problem except relatively expensive and complex electrostatic, electronic or chemical devices or systems. Accordingly, it is the principal object of this invention to provide a water heater construction wherein the adverse accumulations referred to are either eliminated or at least substantially reduced by a relatively inexpensive means. More specifically, this invention is designed to substantially eliminate any tendency of solid materials to accumulate on the central portion of the tank bottom.

SUMMARY OF THE INVENTION

A water heater comprising a watertight tank and a source of heat for heating the water in the tank. The tank is provided with a hot water outlet means at the top portion thereof and an agitator assembly mounted in the bottom portion thereof. The agitator assembly includes a ring-shaped tubular member positioned in the bottom of the tank closely adjacent the side wall of the tank and a secondary tubular member connected to said ring-shaped member and extending horizontally towards the center of the tank. The tubular member is provided with a plurality of openings in a side thereof and said secondary member is provided with an upwardly facing opening therein so that the water flowing from inside the members into the tank will flow in a substantially horizontal direction towards the central portion of the tank in a plane which is closely adjacent to the tank bottom and then upwardly in the central portion of the tank. Venturi fittings are mounted in some of said side openings and in said upwardly facing opening to enhance the desired stirring action. A connector means is provided for connecting the agitator assembly to a source of water.

DESCRIPTION OF THE PREFERRED EMBODIMENT

Figure 1:
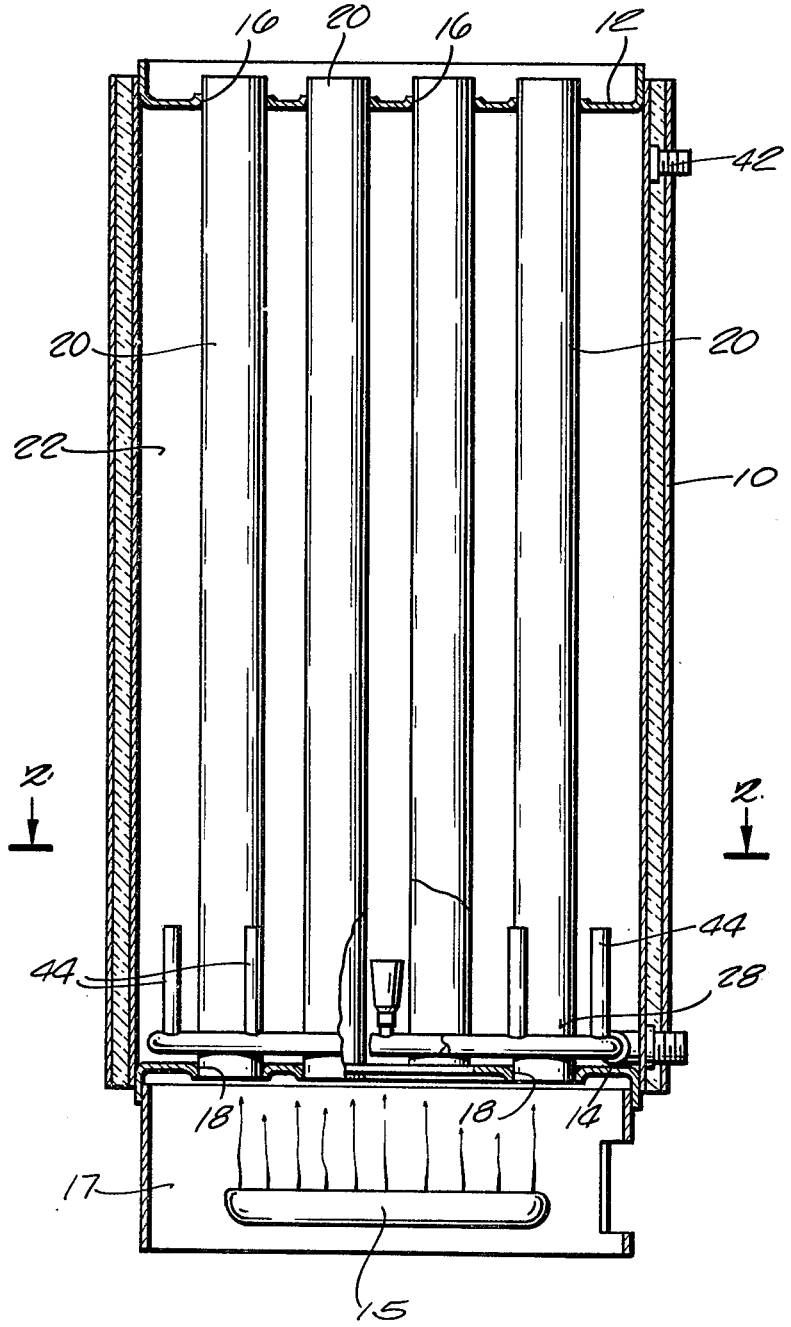
FIG. 1 is a side elevation view (with parts broken away) of a water heater which incorporates the subject matter of the present invention.

Referring to the drawings in detail, the water heater of the present invention is comprised of an insulated tank wall 10, a tank top member 12 and a tank bottom member 14. In a gas fired water heater a burner 15 of conventional construction is mounted in the space 17 below tank bottom member 14. Also in a gas fired water heater top and bottom members 12 and 14 are provided with a plurality of aligned openings 16 and 18, respectively, in which flue tubes 20 are mounted. Tank top and bottom members 12 and 14 are sealed to the tank wall 10 and to the flue tubes 20 by any suitable means such as welding to form a liquidtight tank having a water heating chamber 22 within.

Figure 2:
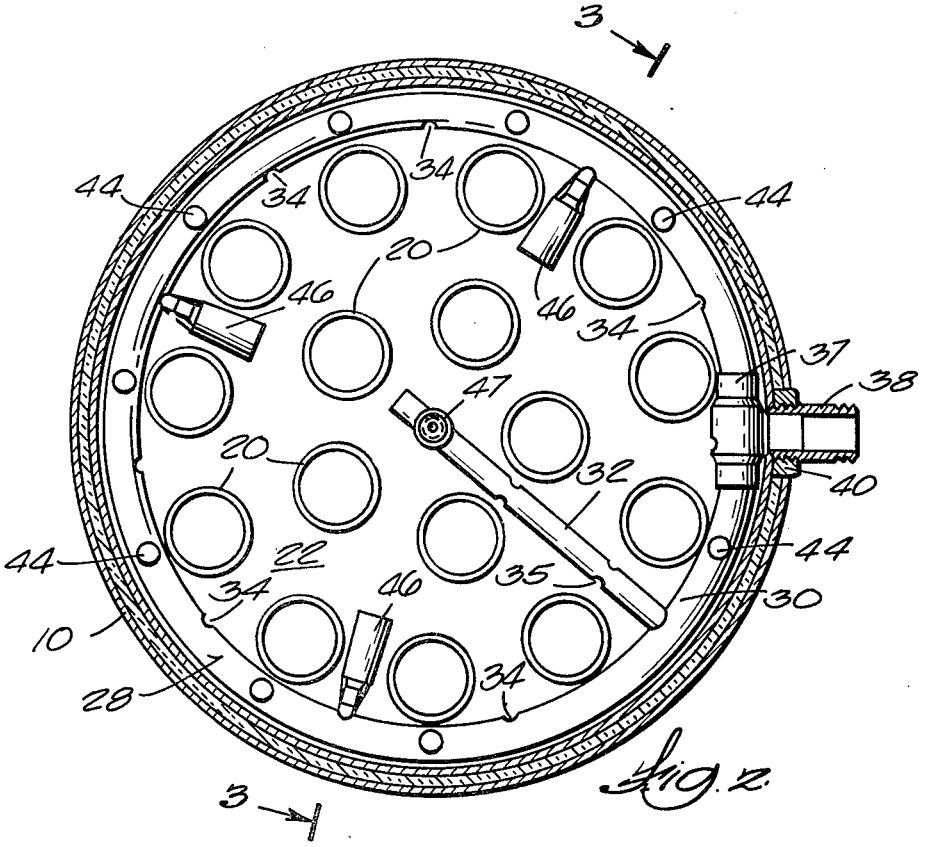
FIG. 2 is a sectional view taken along line 2—2 of FIG. 1.

Mounted in the lower portion of the tank chamber 22 is an agitator assembly 28 comprised of a circular ring portion 30 and a secondary straight tube portion 32 connected thereto. Ring portion 30 is dimensioned to fit closely adjacent the inside wall of wall 10 as best shown in FIG. 2. Straight portion 32 of assembly 28 is dimensioned to extend from a connection point on the inner side of ring portion 30 between flue tubes 20 in a substantially radial direction towards the center of the chamber 22.

Both the ring portion 30 and the straight portion 32 of assembly 28 are provided with a plurality of openings 34 and 35 in the sides of the two portions, respectively, and a single opening 36 near the end of portion 32. The end of tube portion 32 is closed. Openings 34 in the sides of ring portion 30 face toward the center of the tank and openings 35 in straight portion 32 face to opposite sides of portion 32. Opening 36 in portion 32 faces upwardly.

The assembly 28 is provided with any suitable pipe fitting arrangement such as a T-fitting 37, a nipple 38 and a bushing 40 (as best shown in FIG. 2) for connecting the assembly to a source of water under pressure. A hot water outlet fitting 42 is provided at the upper portion of wall 10 as shown in FIG. 1.

Figure 3:
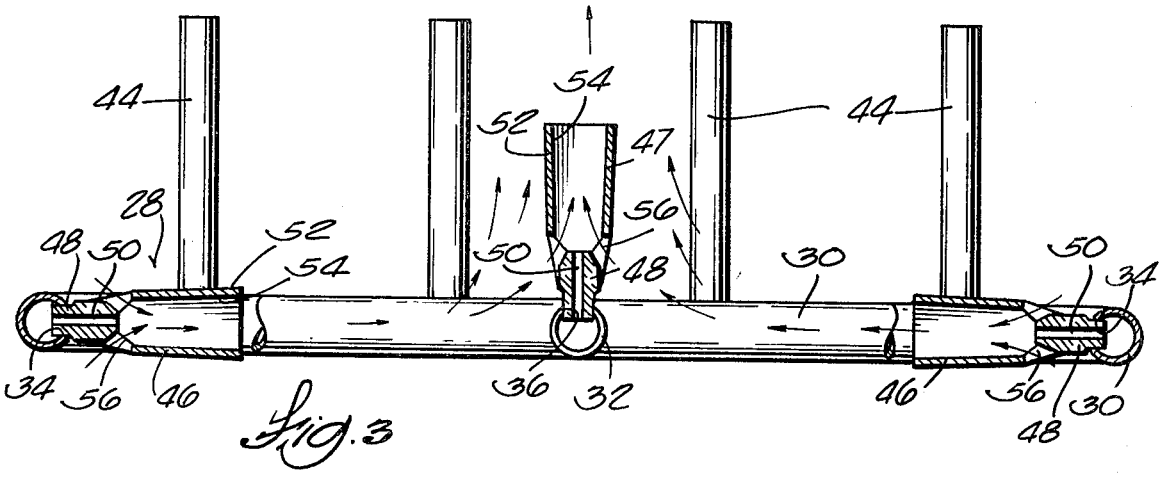
FIG. 3 is an enlarged fragmentary view taken along line 3—3 of FIG. 2.

As best shown in FIGS. 2 and 3, a plurality of venturi fittings 46 are mounted in openings 34 in portion 30 of the agitator assembly. A venturi fitting 47 is mounted in opening 36 in portion 32. Venturi fittings 46 and 47 are comprised of an externally threaded base portion 48 having a small diameter passageway 50 therethrough and a tip portion 52 having a larger diameter passageway 54 therethrough. A plurality of side openings 56 are provided adjacent the area where the end of passageway 50 opens into passageway 54. As best shown in FIG. 2, in the preferred embodiment, three venturi fittings 46 are mounted in ring portion 30. Fittings 46 and straight portion 32 are approximately equally spaced around ring portion 30.

To reduce corrosion of the metal parts of the water heater, a plurality of anode members 44 can be conveniently mounted on the upper surface of assembly 28 as shown in FIGS. 1 and 2. Anode members 44 may be of any suitable anodic material (i.e. higher on the galvanic scale than the tank material) which in the case of a steel tank could be made from aluminum, magnesium or zinc. The members 44 are in the form of round bars having one end thereof adhered to the top surface of the ring portion 30 as best shown in FIG. 2.

Also by making venturi fittings 46 and 47 out of anodic material such as aluminum, magnesium or zinc, such fittings can serve a dual purpose, namely, as a means to increase the stirring action in the bottom of the tank and secondly, as a means to reduce corrosion of the metal parts of the tank. In such an installation the fittings may eventually disintegrate but in such event the stirring action would continue because of the liquid flowing out through openings 34, 35 and 36.

While the novel agitator assembly described above is shown and described for use in a gas fired water heater it should be understood that it could also be used effectively in an electric water heater.

OPERATION

The water in chamber 22 will be heated by the hot gasses and products of combustion passing through flue tubes 20 from burner 26 or in an electric heater the water will be heated by an electric heating element means of any suitable design. As previously explained, a not uncommon problem in the operation of water heaters of the type involved herein is the tendency (depending primarily on local water conditions) of certain dissolved solid materials in the water to precipitate out of the water being heated, which precipitated materials will settle out and accumulate in the bottom portion of the water heater tank. Such scale accumulations, if not periodically removed by some kind of a tank cleaning procedure, will gradually build up, creating an adverse effect on the heating efficiency of the unit and will ultimately cause a premature failure of the heater tank.

With the heater of the present invention when hot water is withdrawn from the chamber 22 through fitting 42 into a domestic water system, for example, cold water will simultaneously flow into the chamber 22 through openings 34 and 35 and venturi fittings 46 and 47 in agitator portions 30 and 32. This substantially horizontal flow of multiple, spaced streams of water into chamber 22 at a level closely adjacent the bottom of the tank will create a substantially uniform stirring action throughout the lower portion of the tank. More specifically, as best shown by the arrows in FIG. 3, the desired stirring action is enhanced by the particular combination of venturi fittings 46 and 47. The horizontally and radially extending venturi fittings 46 produce a pronounced horizontally and radially directed flow towards the center mounted venturi fitting 47. Such flow is at least partially directed upwardly in the central portion of the tank by the action of venturi fitting 47. The combined action of venturi fittings 46 together with venturi fitting 47 substantially eliminates any tendency of solid materials to accumulate on the central portion of the tank bottom.

To summarize, such stirring action will cause any solid materials which have either settled to the bottom or is in the process of settling to the bottom to be maintained in suspension in the water. The normal upward circulation of the water in the tank, as it is heated (plus the action of center venturi fittings 47), will cause such suspended particles to be carried upwardly in the tank and eventually out through outlet 42. Experience has shown that this periodic stirring action produced in the tank each time hot water is withdrawn therefrom, is effective to substantially reduce (and in some instances eliminate) harmful accumulations of scale in the bottom of the tank. A substantially more effective and durable water heater is the result.

I claim:

1. A water heater comprising:

a watertight tank means;

a source of heat for heating water inside said tank means;

a hot water outlet means located in the top portion of said tank;

an agitator assembly means mounted in the bottom portion of said tank, said agitator assembly means including a ring-shaped tubular member positioned closely adjacent the inside wall of said tank means in the bottom portion thereof, said ring-shaped tubular member having a plurality of openings in a side thereof so that water flowing from inside said member into said tank will flow in a substantially horizontal direction towards the central portion of the tank in a plane which is closely adjacent to the tank bottom, said agitator assembly means further including a secondary tubular member connected at one end to said ring-shaped tubular member and extending horizontally therefrom towards the centeral portion of said tank means, said secondary tubular member having an upwardly facing opening adjacent the centeral end thereof, said ring-shaped member having a plurality of horizontally extending venturi fittings mounted in at least some of said side openings therein and said secondary tubular member having an upwardly directed venturi fitting mounted in said upwardly facing opening; and a connector means for connecting said agitator assembly means to a source of water.

2. A water heater according to claim 1 in which said venturi fittings each have a flow passageway therethrough which increases in diameter from its inlet to its outlet end and a plurality of side openings through which water is drawn from the tank when water is caused to flow from inside said ring through said passageway in said venturi fitting.

3. A water heater according to claim 1 in which said venturi fittings are made of anodic material.

4. A water heater according to claim 1 in which there are a plurality of anode members mounted on the top portion of said ring-shaped tubular member.

5. A water heater according to claim 1 in which there are three horizontally extending venturi fittings mounted in openings in said ring-shaped member.

6. A water heater according to claim 5 in which said three horizontally extending venturi fittings and said secondary tubular member are connected to said ring-shaped member at approximately equally spaced points around the periphery thereof.

7. A water heater comprising:

a water tight tank means adapted to contain water under pressure;

a source of heat for heating water inside said tank means;

a hot water outlet means located in the top portion of said tank means for periodically withdrawing heated water from the top portion of said tank means;

an agitator assembly means mounted in the bottom portion of said tank, said agitator assembly means including a tubular member connected to a source of water under pressure to be heated, said tubular member extending into said water tight tank means, said tubular member being imperforate other than having a plurality of small openings therein spaced along the length thereof to direct multiple streams of water under pressure into the tank each time water is drawn out of the top portion of said tank means through said hot water outlet means, said plurality of openings in said otherwise imperforate tubular member positioned so that said multiple streams of water will be directed over and adjacent to the bottom of the tank means to create a stirring action in the lower portion of said tank means to thereby cause solid materials which have either settled to the bottom or are in the process of settling to the bottom to be maintained in suspension in the water so that ultimately at least a portion of such materials will be carried upwardly in said tank means and out said hot water outlet means, the relationship of the aggregate size of the small openings in said otherwise imperforate tubular member to the size of said tubular member itself is such that the velocity of the water flowing into said tank means through said plurality of openings in said tubular member is greater than the velocity of water flowing into said tubular member from the source of cold water under pressure to thereby create the desired stirring action in the bottom portion of said tank means.

8. The method of heating and circulating water in a water tight tank adapted to contain water under pressure comprising the steps of:

(1) periodically withdrawing water from the top portion of the tank;

(2) introducing water into the bottom portion of the tank from a source of water under pressure each time water is withdrawn from the top of the tank;

(3) imparting a stirring action to the water in the bottom portion of the tank each time water is withdrawn and introduced according to steps (1) and (2), such stirring action created by causing the water entering the tank to flow into the tank in the form of multiple streams passing through a plurality of openings spaced along an otherwise imperforate tubular member, said tubular member extending into the tank adjacent the bottom thereof and connected to the source of water under pressure, said openings positioned in the tubular member so that the multiple streams will be directed over and adjacent the bottom of the tank to thereby cause solid materials which have either settled to the bottom or are in the process of settling to the bottom of the tank to be maintained in suspension in the water, said stirring action causing at least a portion of said suspended materials to be carried upwardly in the tank and eventually out through the top portion of the tank, the velocity of the water flowing into the tank through the plurality of openings in the otherwise imperforate tubular member is greater than the velocity of water flowing into the tubular member from the source of water under pressure to thereby create the desired stirring action in the bottom portion of the tank; and (4) applying heat to the water in the tank as it is circulated therethrough.

* * * * *

UNITED STATES PATENT AND TRADEMARK OFFICE

CERTIFICATE OF CORRECTION

PATENT NO. : 4,263,879

DATED : April 28, 1981

INVENTOR(S) : John R. Lindahl

It is certified that error appears in the above—identified patent and that said Letters Patent is hereby corrected as shown below:

| | | |
|---|---|---|
| Column 4, Claim 1, | Line 16, | After "the" delete "cen-" and substitute therefor ---central--- |
| | Line 17, | Before "portion" delete "teral" |
| | Line 19, | After "the" and before "end" delete "centeral" and substitute therefor ---central--- |

Signed and Sealed this

Eighth Day of September 1981

[SEAL]

Attest:

GERALD J. MOSSINGHOFF

Attesting Officer

Commissioner of Patents and Trademarks